United States Patent [19]

Auguadro

[11] 4,191,311

[45] Mar. 4, 1980

[54] TWO COMPARTMENT CONTAINER HAVING PUSH BUTTON ACTUATOR ROD

[76] Inventor: Giuseppe Auguadro, Via G. della Porta, 17, Como, Italy

[21] Appl. No.: 904,954

[22] Filed: May 11, 1978

Related U.S. Application Data

[63] Continuation-in-part of Ser. No. 757,289, Jan. 6, 1977, abandoned.

[51] Int. Cl.[2] ..... A47G 19/24

[52] U.S. Cl. ..... 222/142.6; 222/510

[58] Field of Search ..... 222/144.5, 145, 509, 222/510, 142.6, 142.7

[56] References Cited

U.S. PATENT DOCUMENTS

| | | | |
|---|---|---|---|
| 1,656,449 | 1/1928 | Steiner | 222/142.6 |
| 2,144,981 | 1/1939 | Jones | 222/142.7 X |
| 2,155,534 | 4/1939 | Edwards | 222/142.6 |

*Primary Examiner*—Stanley H. Tollberg

*Attorney, Agent, or Firm*—Beveridge, DeGrandi, Kline & Lunsford

[57] ABSTRACT

A dispensing container has two compartments which have adjacent outlet openings alternately opened and closed by a pivoted closure member. The closure member is moved by a rod which is connected to a pushbutton by a mechanism which moves the rod and closure member to different positions in response to successive manual depressions of the pushbutton.

6 Claims, 5 Drawing Figures

2
4
6
8
10
11
12
16
17
18
19
20
22
24
26
28
30
32
33
34
38

TWO COMPARTMENT CONTAINER HAVING PUSH BUTTON ACTUATOR ROD

REFERENCE TO RELATED APPLICATION

This is a continuation in part of my earlier U.S. patent application Ser. No. 757,289, filed Jan. 6, 1977, entitled Table Fitting, now abandoned.

BACKGROUND AND SUMMARY OF THE INVENTION

This invention relates to a dispensing container provided with compartments for holding different fluent substances, provided with a pivoted closure and actuating means which enables the device to dispense a selected substance from one of the compartments.

In the past, salt and pepper dispensers have been provided with one valve and actuator mechanism for the salt dispensing openings and another valve and actuator mechanism for the pepper dispensing openings. Exemplary devices of this type are disclosed in German Pat. No. 815,388 and U.S. Pat. Nos. 1,575,506 and 1,965,919. In one prior device which is the subject of U.S. Pat. No. 1,496,571, a single actuator operates a sliding valve plate to open either the salt dispensing openings or the pepper dispensing openings.

The present invention pertains to an improvement wherein a closure member is pivoted and is provided with first and second portions which are associated respectively with the outlet openings of the first and second compartments of the container. The closure portions are relatively positioned so that when one of the outlet openings is opened, the other outlet opening is closed. The closure member is actuated by a rod operatively connected to a manually operated pushbutton by a mechanism which holds the rod at its extended position and then at a retracted position in response to successive manual depressions of the button.

While the invention may take many forms, a preferred embodiment thereof is described hereinbelow.

BRIEF DESCRIPTION OF A PREFEERRED EMBODIMENT

Figures 1, 2, 3, 4, 5:
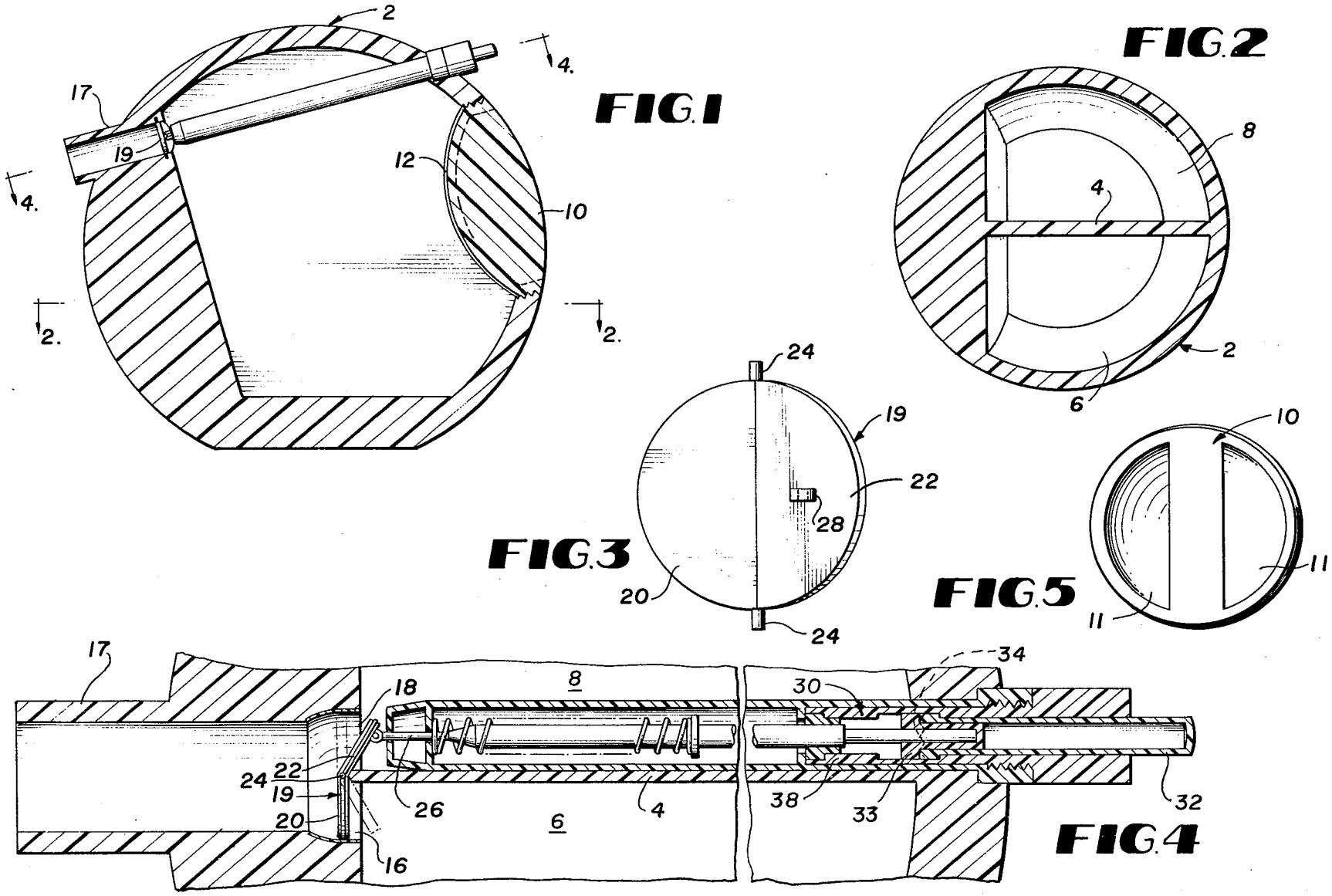
FIG. 1 is a sectional view taken through a vertical plane of a dispenser constructed according to the invention.
FIG. 2 is a sectional view of the container as seen along the line 2—2 in FIG. 1.
FIG. 3 is an enlarged elevational view of the pivoting closure used in the device.
FIG. 4 is an enlarged fragmentary sectional view of the device as seen along the line 4—4 in FIG. 1.
FIG. 5 is a view of the exterior surface of the fill cap of the device.

The container of the preferred embodiment comprises a generally spherical external shell 2 having an internal partition 4 which divides the interior of the device into compartments 6 and 8 suited for holding different fluent materials such as oil and vinegar. A fill cap 10 for compartments 6 and 8 is threaded to the shell and has a spherical inner surface which conforms to and seals against an arcuate surface 12 of partition 4 to prevent liquid from flowing between the compartments. Recesses 11 are located in the external surface of the cap 10 as shown in FIG. 5 providing therebetween a handgrip which facilitates manual removal of the cap.

As seen in FIG. 4, the compartment 6 has an outlet opening 16 and the compartment 8 has an outlet opening 18. These outlet openings are adjacent to each other and are located in an upper portion of the device to permit material in the respective compartments to flow therethrough upon inversion of the container. Both openings lead to a pouring spout 17.

The device is constructed so that only one of the openings 16 or 18 is open at any given time. FIGS. 1 and 4 show a valve closure member 19 formed of an integral piece of material having a valve portion 20 operable in the outlet opening 16 and a valve portion 22 operable in the outlet opening 18. The member 19 is pivotally supported on a pin 24 for movement between a first position shown in solid lines in FIG. 4 and a second position shown in dot-dash lines. When the member 19 is in the first position shown in solid lines, its portion 20 obstructs the outlet opening 16 and the portion 22 does not obstruct the outlet opening 18, thereby permitting material to be dispensed from chamber 8 through spout 17 when the device is inverted. When the member 19 is in the second or broken line position, material may be poured from the compartment 6 but not from the compartment 8, as the portion 20 does not obstruct the outlet opening 16 but the portion 22 does close off the outlet opening 18. Preferably, the walls of openings 16 and 18 and the circumferential edges of the portions 20 and 22 are provided with engaging sealing surfaces which prevent leakage of liquid through the respective outlet openings when closed.

A rod 26 is a preferred actuator for moving the member 19 between the two illustrated positions. This rod is linearly movable along its longitudinal axis which lies substantially perpendicular to the pivot axis of pin 24. The rod 26 has a bifurcated tip connected to a sleeve 28 which is integral with the member 19 and spaced from its pivot axis. To enable the bifurcated tip of rod 26 to follow the arc of sleeve 28 in instances where the axis of rod 26 is not perpendicular to the pivot axis of member 19, the rod 26 may be capable of some lateral play; or, the connection between rod 26 and sleeve 28 may be articulated or possess sufficient play to permit such movement. Rod 26 is movable from the illustrated retracted position to an extended position where, of course, the member 19 will occupy its second position shown in broken lines. When rod 26 is in its retracted position, liquid from compartment 8 may be poured from the container; and, when the rod 26 is in its extended position, liquid from compartment 6 may be poured through its outlet opening 16.

The rod 26 is biased toward a retracted position by compression spring 40. The distal end of the rod 26 is connected to a retractor mechanism 30 which is provided with a manually operated pushbutton 32. The retractor mechanism preferably is a well-known mechanism used for retractible writing instruments such as ballpoint pens wherein the rod 26 is held first at its extended position and then at its retracted position in response to successive manual depressions of the pushbutton 32. The particular mechanism shown here involves a rotary cap 33 on the distal end of rod 26 provided with teeth which are engaged by crown gear teeth 34 on the lower end of the pushbutton 32. These elements are slidable within the member 38 which is internally grooved to prevent rotation of the pushbutton 32 and to cause the rotary cap 34 to occupy an extended position for one pushbutton depression and a retracted position for the subsequent pushbutton depression, thereby moving the rod 26 as previously described. A wide variety of retractor mechanisms for ballpoint pens are quite suitable for this structure, typical mechanisms of this nature being disclosed in U.S. Pat. Nos. 3,051,132; 3,075,497; 3,079,894; 3,288,115; 3,652,173; 3,653,777 and 3,810,701.

When the device is used for holding salad condiments such as oil and vinegar, a diner initially inverts the device to pour one of the condiments through spout 17 onto his salad. Then, he depresses the pushbutton 32 and then inverts the device to dispense the other condiment. It is appropriate to provide the pushbutton 32 or some other portion of the apparatus with a position indicator which signifies the particular material which is dispensable from the device at any given time.

Persons familiar with this art will realize that this invention may assume a wide variety of forms other than the specific embodiment shown herein. For example, there may be two spaced-apart outlet openings, two pushbuttons, two rods and two retractor mechanisms, each retractor mechanism being connected to a suction cup which is movable to open and close its respective outlet opening. Therefore, it is emphasized that the invention is not limited solely to the disclosed embodiment but embraces a wide variety of modifications thereto and variations thereof which fall within the spirit of the following claims.

I claim:

1. A dispensing container comprising, a first compartment having a first outlet opening in an upper portion thereof to permit material in said first compartment to flow through said first outlet opening upon inversion of the container, a second compartment having a second outlet opening in an upper portion thereof, to permit material in said second compartment to flow through said second outlet opening upon inversion of the container, said second outlet opening being adjacent to said first outlet opening, a movable closure member, pivot means supporting said closure member for pivotal movement between a first position and a second position, said closure member including a first closure portion in said first outlet opening, said first closure portion occupying a closed position where it obstructs said first outlet opening when the closure member is in its first position and occupying an open position where said first outlet opening is open when the closure member is in its second position, said closure member also including a second closure portion in said second outlet opening, said second closure portion occupying a closed position where it obstructs said second outlet opening when the closure member is in its second position and occupying an open position where said second outlet opening is open when the closure member is in its first position, actuator means for moving said closure member from its first position to its second position, said actuator means including a rod connected to said closure member at a point spaced from said pivot axis, said rod being axially movable from a retracted position which it occupies when said closure member is in said first position to an extended position which it occupies when said closure member is in said second position, said actuator means also including a manually operated pushbutton and means for holding said rod at its extended position and then at its retracted position in response to successive manual depressions of said pushbutton.

2. The dispensing container of claim 1 having an external shell and an internal partition separating said first compartment from said second compartment, said pivot means being located on said partition, said first closure portion being rigidly connected to and angularly inclined with respect to

3. The dispensing container of claim 2 having a fill cap threaded to said shell, said fill cap having a spherical surface, said partition having an arcuate surface in sealing engagement with the spherical surface of the fill cap.

4. The dispensing container of claim 1 having a fill cap threaded to said shell, said fill cap having a spherical surface, said partition having an arcuate surface in sealing engagement with the spherical surface of the fill cap.

5. A dispensing container comprising, a first compartment having a first outlet opening in an upper portion thereof to permit material in said first compartment to flow through said first outlet opening upon inversion of the container, a second compartment having a second outlet opening in an upper portion thereof to permit material in said second compartment to flow through said second outlet opening upon inversion of the container, a closure member located in said first outlet opening and being movable from a closed position to an open position, actuator means for moving said closure member from its open position to its closed position, said actuator means including a rod connected to said closure member, said rod being axially movable from a retracted position to an extended position, a manually operated pushbutton and means for holding said rod at its extended position and then at its retracted position in response to successive manual depressions of said pushbutton.

6. An oil and vinegar dispenser comprising, a first compartment having a first outlet opening in an upper portion thereof to permit material in said first compartment to flow through said first outlet opening when the container is tilted, a second compartment having a second outlet opening in an upper portion thereof to permit material in said second compartment to flow through said second outlet opening when the container is tilted, pour spout means extending laterally from said outlet openings for releasing oil and vinegar from said compartments, closure members located in said outlet openings, said closure members being movable from a closed position to an open position, actuator means for moving at least one of said closure members from its open position to its closed position, said actuator means including a rod connected to said closure member, said rod being axially movable from a retracted position to an extended position, a manually operated pushbutton on said rod for moving said closure member from its closed position to its open position to enable material to flow from the compartment when the dispenser is tilted.

* * * * *